US006292947B1

(12) United States Patent
Bechis

(10) Patent No.: US 6,292,947 B1
(45) Date of Patent: Sep. 25, 2001

(54) BATH COSTUME WITH HIGH WATER SLIPPING PROPERTIES

(76) Inventor: Michele Bechis, Via Statale, 24 -22055, Merate (Lecco) (IT)

( * ) Notice: Subject to any disclaimer, the term of this patent is extended or adjusted under 35 U.S.C. 154(b) by 0 days.

(21) Appl. No.: 09/440,348

(22) Filed: Nov. 15, 1999

(30) Foreign Application Priority Data

Jan. 20, 1999 (IT) ..... MI99U0032

(51) Int. Cl.[7] ..... A41D 7/00
(52) U.S. Cl. ..... 2/67
(58) Field of Search ..... 2/67, 113, 114, 2/118; 450/11, 93; D2/731, 732, 737, 734

(56) References Cited

U.S. PATENT DOCUMENTS

D. 238,116 * 12/1975 Firkear ..... D2/2
D. 300,382 * 3/1989 Keithan ..... D2/24
1,446,928 * 2/1923 Redmond ..... 450/93
4,306,317 * 12/1981 Joseph ..... 2/67
4,343,044 * 8/1982 Borda et al. ..... 2/67
4,372,320 * 2/1983 Silber ..... 128/455
4,583,544 * 4/1986 Flanagan et al. ..... 128/482
4,654,894 * 4/1987 Kudo ..... 2/67
4,802,469 * 2/1989 Gollestani ..... 128/98.1
4,875,236 * 10/1989 Boynton ..... 2/67
4,916,755 * 4/1990 Feigenbaum et al. ..... 2/67
4,956,878 * 9/1990 Boynton ..... 2/67
4,957,466 * 9/1990 Hopps ..... 450/85
5,033,116 * 7/1991 Itagaki et al. ..... 2/67
5,586,340 * 12/1996 Russo ..... 2/67
5,996,120 * 12/1999 Balit ..... 2/67

* cited by examiner

*Primary Examiner*—John J. Calvert
*Assistant Examiner*—Alissa L. Hoey
(74) *Attorney, Agent, or Firm*—Hedman & Costigan, P.C.

(57) ABSTRACT

A bath costume comprises a bath costume body made of a resilient material adapted to perfectly adhere to a user body, and having an outer smooth surface in order to reduce to a minimum the slipping resistance of the bath costume in water.

3 Claims, 2 Drawing Sheets

BATH COSTUME WITH HIGH WATER SLIPPING PROPERTIES

BACKGROUND OF THE INVENTION

The present invention relates to a bath costume having a high water slipping capability.

As is known, prior bath costumes are conventionally made of elasticized fabrics which, however, are affected, in a variable amount depending on the fabric type, by the drawback that they absorb water and, accordingly, their weight is greatly increased, which represents an obstacle for a swimming user.

In particular, if the bath costume must be used in sports activity and the like, this weight increase can greatly hinder the performance of a swimming user.

Moreover, an elasticized knitted fabric material, like that which is conventionally used for making prior bath costumes, is inevitably provided with a not perfectly smooth surface, which generates great fluidodynamic frictions, causing a great reduction of the swimming performance of the bath costume user.

The above mentioned aspects are further aggravated as the bath costume is worn by a swimming woman, since the typical anatomy of a woman body would provide further surface unevenesses which constitute an additional braking factor with respect to the slipping properties of the bath costume through water.

From the above discussion it should be apparent that it would be desirable to provide a bath costume having high water slipping properties, thereby overcoming or greatly reducing the above discussed problems.

SUMMARY OF THE INVENTION

Accordingly, the aim of the present invention is to provide a bath costume having a high water slipping property, in which any absorption of water is fully prevented from occurring, thereby allowing a bath costume user to better exploiting its muscular swimming performance.

Within the scope of the above mentioned aim, a main object of the present invention is to provide a bath costume having a high water slipping property, which is specifically designed for a woman body, thereby further improving the swimming performance of a woman.

A further object of the present invention is to provide a bath costume which is very reliable and safe in operation.

According to one aspect of the present invention, the above mentioned aim and objects, as well as yet other objects, which will become more apparent hereinafter, are achieved by a bath costume having high water slipping properties, characterized in that said bath costume comprises a bath costume body made of a resilient material adapted to perfectly adhere to the body of a user, and provided with a smooth outer surface to reduce to a minimum a slipping resistance of said bath costume in water.

According to a further preferred embodiment of the invention, the bath costume body is divided into a top portion and a bottom portion, having different thicknesses, said bottom portion of said bath costume body having, in particular, a thickness greater than that of said top portion thereof.

According to a further preferred embodiment of the present invention, the bath costume body is provided with a horizontal band, arranged at a lower position with respect to the user breast, and involving at least a portion of the circumferential extension of the lower or bottom portion of said bath costume body, and being made of the same material constituting the latter.

Said bath costume body is moreover provided, at the user breast, with slightly projecting thin material portions.

According to a further preferred embodiment of the present invention, the bath costume body is made of a waterproof material, preferably a rubber latex or silicone rubber material.

BRIEF DESCRIPTION OF THE DRAWINGS

Further advantages and characteristics of the present invention will become more apparent hereinafter from the following detailed disclosure, given by way of an illustrative but not limitative example, with reference to the accompanying drawings, where.

DESCRIPTION OF THE PREFERRED EMBODIMENTS

In the following disclosure, reference will be made to a preferred embodiment of the present invention, which has been illustrated by way of a not indicative example of several possible variations of the invention.

Figure 1:
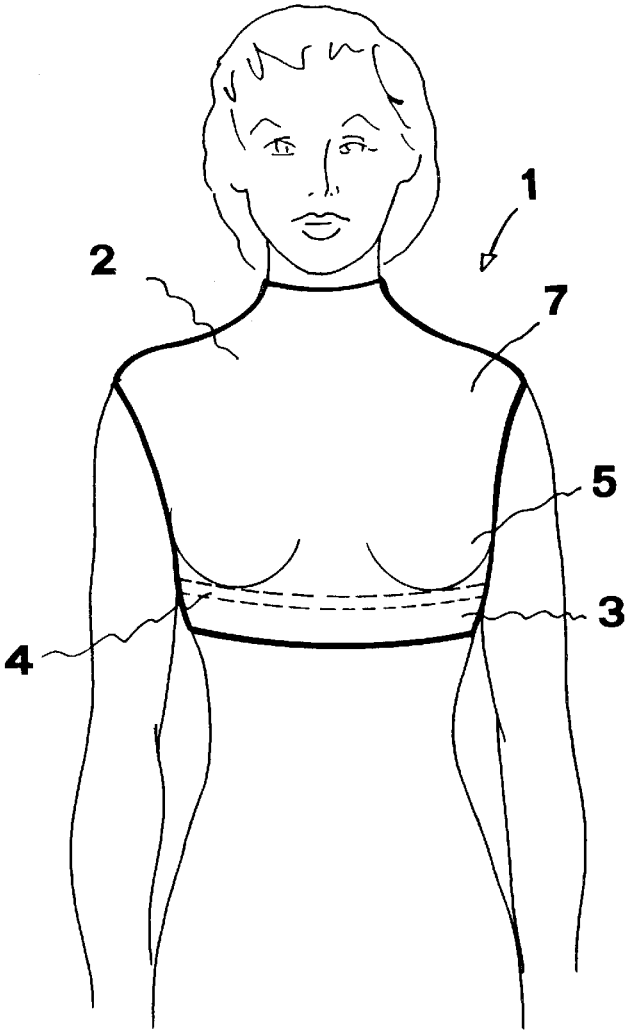
FIG. 1 is front view of the bath costume according to the present invention, as worn by a woman.

In FIG. 1, the bath costume, having a high water slipping property according to the present invention has been generally indicated by the reference number 1.

Figure 2:
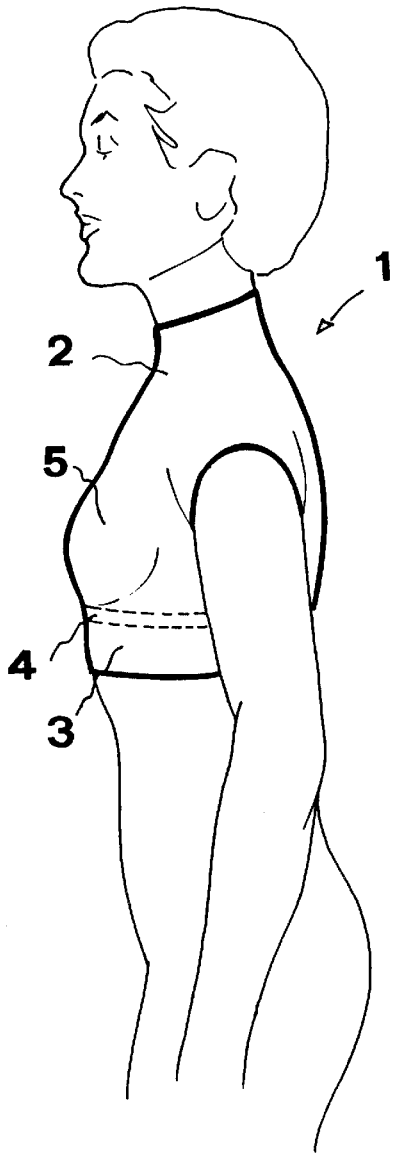
FIG. 2 is a side view of the bath costume body of FIG. 1, in a worn condition thereof.
Figure 3:
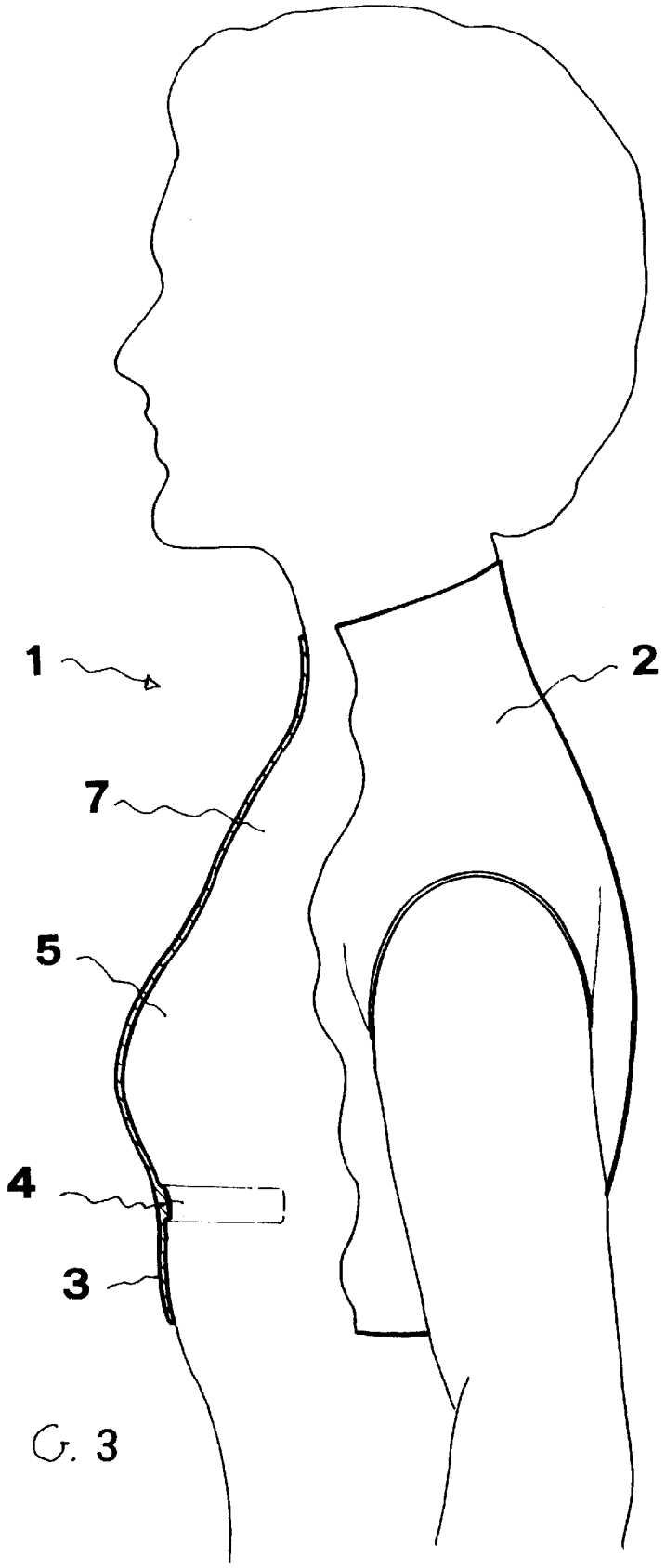
FIG. 3 is a partially cross-sectioned side view of the bath costume body.

Said bath costume comprises a bath costume body 2, made of resilient material, so as to completely and perfectly adhere to the upper portion of the truck of a woman who wears the bathe costume. In particular the bath costume body (as shown in FIGS. 1, 2) tightly encompasses the upper trunk of a woman from a region immediately under her breast to approximately midway of her neck, the costume shoulders ending at approximately the area where the arms meet the torso.

The bath costume body 2 is provided with an outer smooth surface to reduce to a minimum the water slipping resistance.

As shown, said bath costume body 2 comprises a top portion 7 and a bottom portion 3 integral therewith.

According to the invention, said portions have a different thickness.

More specifically, the bottom portion 3 of the bath costume body 2 has a thickness greater than that of the top portion 7, to allow the bath costume body 2 perfectly adhere to the body of a woman.

Moreover, the bath costume body 2 is provided with a horizontal band 4, arranged at a lower position from the woman breast, affecting at least a portion of the circumferential extension of the bottom portion 3 of the bath costume body 2.

Preferably, said horizontal band 4 is made of the same material forming the bath costume body 2.

Said bath costume body 2 is moreover provided, at the woman breast, with slightly projecting thin material portions 5.

Said bath costume body 2 is made of a waterproof material, in particular a rubber latex or silicone rubber material, which materials would allow said bath costume body 2 to present a smooth outer surface, in order to improve its water slipping capability.

Said materials, moreover, have high resilient properties allowing said bath costume body 2 to perfectly adhere to the body of the user.

The horizontal band 4, arranged under the woman breast, will allow to properly support the woman breast in all operating conditions.

The slightly projecting thin material portions 5, in particular, provide the bath costume body 2 with better comfort and wearing properties.

From the above disclosure it should be apparent that the invention fully achieves the intended aim and objects.

What is claimed is:

1. A woman's bath costume having a high water sliding property, comprising a bath costume body, made of a resilient material adapted to perfectly adhere to a body of said woman and provided with an outer smooth surface to reduce to a minimum a water slipping resistance thereof, wherein said bath costume body is completely made of a waterproof material and is adapted, as it is worn by said woman, to tightly encompass an upper portion of a trunk of said woman to approximately midway up on the neck of said women, and said costume having an outer edge of the upper portion at shoulder position which ends approximately at the juncture of arm and torso.

2. A woman's bath costume according to claim 1, said bath costume body comprising a top portion arranged above the woman's breast and a bottom portion arranged under the woman's breast as said costume is worn, wherein said bottom portion has a thickness greater than that of said top portion.

3. A woman's bath costume according to claim 1, wherein said bath costume body is provided with a horizontal band, arranged circumferentialy to be under the woman's breast, as said costume is worn said horizontal band being made of the same waterproof material as said bath costume body, said costume body being provided, at said woman's breast, with projecting thin portions.

* * * * *